US005738562A

United States Patent [19]

Doan et al.

[11] Patent Number: 5,738,562

[45] Date of Patent: Apr. 14, 1998

[54] APPARATUS AND METHOD FOR PLANAR END-POINT DETECTION DURING CHEMICAL-MECHANICAL POLISHING

[75] Inventors: Trung Tri Doan; Gurtej Singh Sandhu, both of Boise, Id.; Malcolm K. Grief, Chandler, Ariz.

[73] Assignee: Micron Technology, Inc., Boise, Id.

[21] Appl. No.: 590,541

[22] Filed: Jan. 24, 1996

[51] Int. Cl.[6] ..... B24B 49/16

[52] U.S. Cl. ..... 451/5; 451/41; 451/287; 451/288

[58] Field of Search ..... 451/41, 283, 285, 451/287, 288, 5, 9

[56] References Cited

U.S. PATENT DOCUMENTS

| | | | |
|---|---|---|---|
| 3,911,562 | 10/1975 | Youmans | 29/590 |
| 4,702,792 | 10/1987 | Chow et al. | 156/628 |
| 4,944,836 | 7/1990 | Beyer et al. | 156/645 |
| 5,036,015 | 7/1991 | Sandhu et al. | 437/8 |
| 5,069,002 | 12/1991 | Sandhu et al. | 51/165 R |
| 5,232,875 | 8/1993 | Tuttle et al. | 437/225 |
| 5,308,438 | 5/1994 | Cote et al. | 451/41 |
| 5,461,007 | 10/1995 | Kobayashi | 437/225 |
| 5,486,129 | 1/1996 | Sandhu et al. | 451/10 |

OTHER PUBLICATIONS

F.B. Kaufman et al., "Chemical–Mechanical Polishing for Fabricating Patterned W Metal Features as Chip Interconnects," J. Electrochemical Society, vol. 138, No. 11, pp. 3460–3465, Nov. 1991.

Patrick, William J. et al., "Application of Chemical Mechanical Polishing to the Fabrication of VLSI Circuit Interconnections," J. Electrochemical Society, vol. 138, No. 6, pp. 1778, 1784, Jun. 1991.

Singer, Pete, "The Interconnect Challenge: Filling Small, High Aspect Ratio Contact Holes," Semiconductor International, pp. 57–64, Aug. 1994.

Vossen, John L. and Werner Kern, Editors, "Thin Film Processes," Academic Press Inc., pp. 406, 427, 430, 438–440, 443–444, 463, 474–475, 1978.

*Primary Examiner*—Eileen P. Morgan

*Attorney, Agent, or Firm*—Seed and Berry LLP

[57] ABSTRACT

A chemical-mechanical polishing apparatus includes a slurry-wetted polishing pad attached to a substantially planar surface of a platen. A wafer carrier is positioned in close proximity to the platen, and it has a substantially planar surface to which one side of a semiconductor wafer is removably attachable so that an opposing side of the semiconductor wafer is disposed against the polishing pad. An actuator imparts a translational motion to the platen so that the polishing pad moves relative to and in polishing contact with the semiconductor wafer. A sensor detects a change in the imparted translational motion corresponding to a change in the coefficient of friction between the polishing pad and the opposing side of the semiconductor wafer indicative of a planar end point on the opposing side of the semiconductor wafer. The sensor preferably includes a laser and a laser detector using a laser reflection or laser interferometric method to detect the change in the imparted translational motion. Also, the apparatus preferably includes a controller coupled to the sensor and the actuator to adjust the actuator in response to the sensor detecting a change in the imparted translational motion.

41 Claims, 1 Drawing Sheet

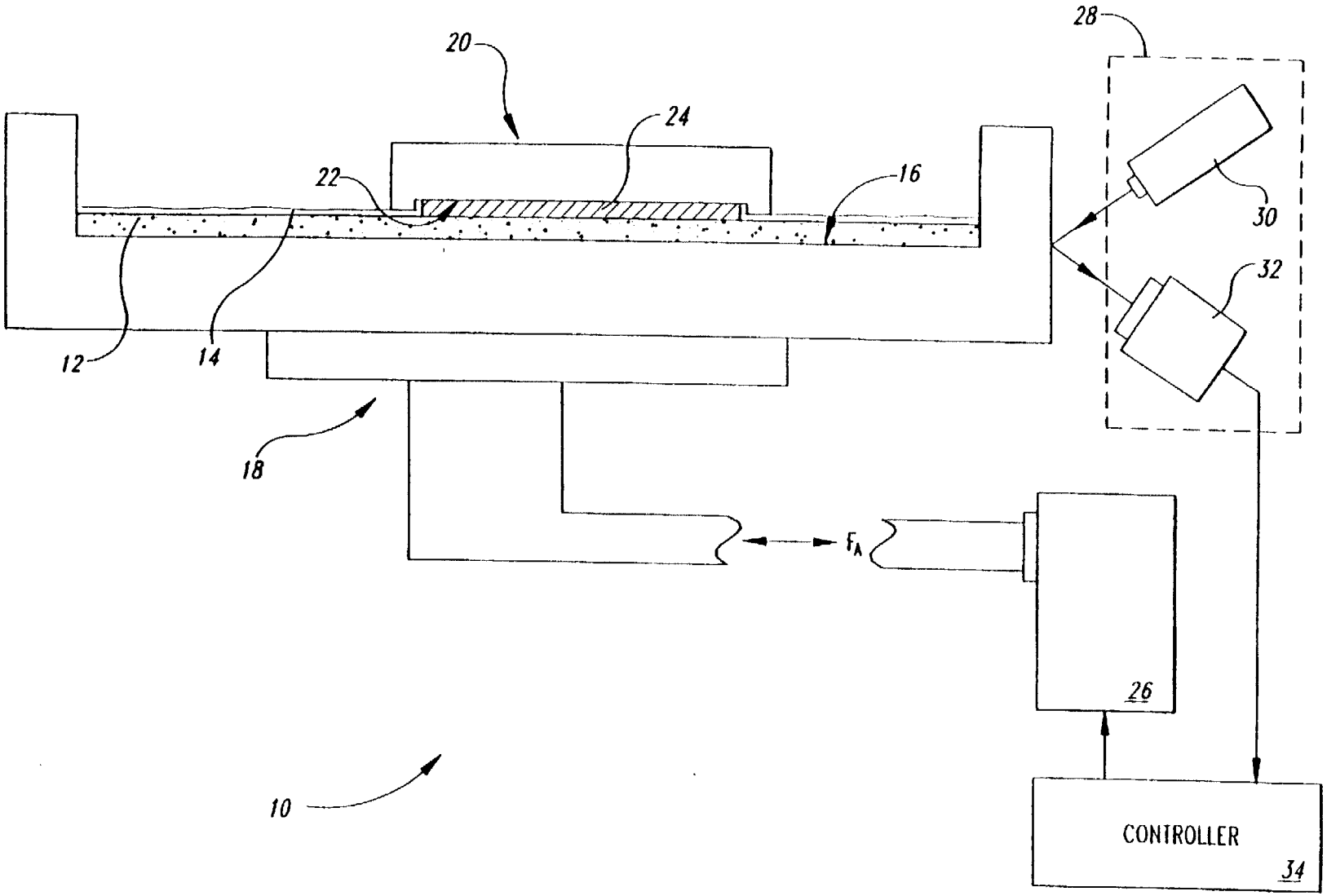
28
30
32
34
CONTROLLER
26
16
$F_A$
24
20
22
14
12
18
10

APPARATUS AND METHOD FOR PLANAR END-POINT DETECTION DURING CHEMICAL-MECHANICAL POLISHING

FIELD OF THE INVENTION

This invention relates in general to chemical-mechanical polishing of semiconductor wafers, and in particular to planar end-point detection during chemical-mechanical polishing.

BACKGROUND OF THE INVENTION

Chemical-mechanical polishing is a process used to manufacture semiconductors. Typically, chemical-mechanical polishing involves rotating a thin, flat semiconductor wafer against a polishing pad, rotating the polishing pad against the wafer, or both. A chemical slurry containing a polishing agent, such as alumina or silica, acts as an abrasive medium between the wafer and the pad. In general, a semiconductor wafer is subjected to chemical-mechanical polishing in order to remove layers of material, surface defects such as crystal lattice damage, scratches, roughness, or embedded particles of dirt or dust from the wafer.

During chemical-mechanical polishing, it is often desirable to stop polishing a semiconductor wafer at a planar junction between two layers of different material. In this manner, layers underlying a top layer can be exposed without being damaged. Such planar junctions are called planar end-points.

Conventional chemical-mechanical polishing does not provide a suitable method for detecting a planar end-point. For example, one conventional method requires a technician to remove a semiconductor wafer from the chemical-mechanical polishing process, inspect the wafer for the desired end-point, and then return the wafer to the process if the desired end-point is not observed. This is obviously unnecessarily time-consuming.

Therefore, there is a need in the art for a chemical-mechanical polishing apparatus and method which provide a suitable method for detecting a planar end-point.

SUMMARY OF THE INVENTION

The present invention provides a chemical-mechanical polishing apparatus and method in which a slurry-wetted polishing pad is attached to a substantially planar surface of a platen. A wafer carrier positioned in close proximity to the platen has a substantially planar surface to which one side of a semiconductor wafer is removably attachable so that an opposing side of the semiconductor wafer is disposed against the polishing pad. An actuator imparts motion to either the platen or the wafer carrier so that the polishing pad moves relative to the semiconductor wafer during polishing. Finally, a sensor detects a change in the imparted motion corresponding to a change in the coefficient of friction between the polishing pad and the opposing side of the semiconductor wafer. The coefficient of friction changes when the planar end point on the opposing side of the semiconductor wafer is reached.

Preferably, a controller operatively coupled to the sensor and the actuator adjusts the actuator in response to the sensor detecting a change in the imparted translational motion. Also, the sensor preferably comprises a laser and a laser detector, such as a laser reflection or laser interferometric detector.

BRIEF DESCRIPTION OF THE DRAWINGS

The FIGURE is an elevational and block diagram of a preferred chemical-mechanical polishing apparatus according to the present invention.

DETAILED DESCRIPTION OF THE INVENTION

In a preferred embodiment shown in the FIGURE, the present invention provides a chemical-mechanical polishing apparatus 10 comprising a conventional polishing pad 12 wetted with a slurry 14 and attached to a substantially planar surface 16 of a conventional platen 18. The apparatus 10 also comprises a conventional wafer carrier 20 having a substantially planar surface 22 to which a semiconductor wafer 24 is removably attached. Those having skill in the field of this invention will, of course, understand that a wide variety of variations to the design of the described chemical-mechanical polishing apparatus are possible, and that these variations are encompassed within the scope of the claims. For example, although the wafer carrier 20 is depicted in the FIGURE as being held on the polishing pad 12 by the force of gravity, it will be understood that the wafer carrier 20 could also be held against the polishing pad 12 by a force exerted by a mechanical arm attached to the wafer carrier 20.

The chemical-mechanical polishing apparatus 10 also comprises a conventional actuator 26 which applies a constant back-and-forth force $F_A$ to the platen 18 for a fixed period of time in order to impart a translational motion to the platen 18. The actuator 26 is a well-known device in the field of this invention, and it often comprises an electric motor or a hydraulic device. Also, it will be understood that the force $F_A$ may be applied to the wafer carrier 20 instead of the platen 18. Further, although the motion imparted to the platen by the actuator is described as being translational, it will be understood that the motion may also be rotational. It will also be understood that the wafer carrier 20 may rotate by itself or as a result of application of a force such as the force $F_A$.

The translational motion imparted to the platen 18 causes it to move relative to the wafer carrier 20, and to thereby polish the semiconductor wafer 24. Because the force $F_A$ is a constant force, the platen 18 will travel a translational distance X equal to:

$$X=\tfrac{1}{2}\cdot((F_A-(m_p\cdot a_g\cdot\mu_f))/m_p)\cdot t^2 \quad (1)$$

where $m_p$ is the mass of the platen 18, $a_g$ is the acceleration due to gravity, and $\mu_f$ is the coefficient of friction between the semiconductor wafer 24 and the polishing pad 12. Because the force $F_A$ is applied for a fixed period of time $t_c$, the platen 18 will have traveled a maximum translational distance $X_{MAX}$ at the lime $t_c$. Also, the platen 18 will achieve a translational velocity V equal to:

$$V=((F_A-(m_p\cdot a_g\cdot\mu_f))/m_p)\cdot t \quad (2)$$

The platen 18 will, of course, achieve a maximum translational velocity $V_{MAX}$ at the time $t_c$.

Because the type of material being polished in the semiconductor wafer 24 changes at a planar end-point, the coefficient of friction $\mu_f$ between the wafer 24 and the polishing pad 12 also changes at a planar end-point. This change in the coefficient of friction $\mu_f$ is reflected in a change in $X_{MAX}$ and $V_{MAX}$. Thus, a change in $X_{MAX}$ or $V_{MAX}$ is indicative of a planar end-point.

The chemical-mechanical polishing apparatus 10 further includes a sensor 28 for detecting a change in the motion imparted to the platen 18 indicative of a planar end-point on the semiconductor wafer 24. Preferably, the sensor 28 comprises a laser 30 and a laser detector 32 which detect a change in $X_{MAX}$ or $V_{MAX}$ using well-known methods, such as the laser reflection method and the laser interferometric method. For example, if a laser beam from the laser 30 leaves the laser 30 at the time $t_c$, and the laser beam reflects off the moving platen 18 and is received by the laser detector 32 at a later time $t_1$, then the maximum translational distance $X_{MAX}$ can be calculated as:

$$X_{MAX}=c\cdot(t_1-t_c) \quad (3)$$

where c is the speed of light and is approximately 300.000 kilometers per second. A change in $X_{MAX}$ indicative of a planar end-point can thus be detected as a function of a change in the time of flight $(t_1-t_c)$ of the laser beam. Although the sensor has been described with respect to a laser and a laser detector, it will be understood that the claims are not so limited.

The chemical-mechanical polishing apparatus 10 also preferably comprises a conventional controller 34 operatively coupled to the sensor 28 and the actuator 26 to adjust the actuator 26 in response to the sensor 28 detecting a change in the motion imparted to the platen 18.

Although the present invention has been described with reference to a preferred embodiment, the invention is not limited to this preferred embodiment. Rather, the invention is limited only by the appended claims, which include within their scope all equivalent devices or methods which operate according to the principles of the invention as described.

We claim:

1. A polishing apparatus comprising:

a platen having a substantially planar surface;

a polishing pad attached to the platen's substantially planar surface;

a wafer carrier positioned in close proximity to the platen, the wafer carrier having a substantially planar surface to which one side of a semiconductor wafer is removably attachable so that an opposing side of the semiconductor wafer is disposed against the polishing pad;

an actuator for imparting a motion to one of the platen and the wafer carrier so that the polishing pad moves relative to and in polishing contact with the semiconductor wafer the imparted motion having a maximum translational distance that changes in magnitude when the coefficient of friction between the wafer and the polishing pad changes; and a sensor for detecting a change in the maximum translational distance in the imparted motion resulting from a change in the coefficient of friction between the polishing pad and the opposing side of the semiconductor wafer indicative of a planar end-point on the opposing side of the semiconductor wafer.

2. The apparatus of claim 1 further comprising a controller operatively coupled to the sensor and the actuator for adjusting the actuator in response to the sensor detecting a change in the imparted motion.

3. The apparatus of claim 1 wherein the actuator moves the one of the platen and the wafer carrier to a maximum translational velocity whose magnitude changes when the coefficient of friction changes, wherein the sensor detects a change in the maximum translational velocity in order to detect a planar end-point on the opposing side of the semiconductor wafer.

4. The apparatus of claim 1 wherein the sensor comprises an interferometer.

5. The apparatus of claim 1 wherein the sensor comprises:

a laser for providing a laser beam incident on the one of the platen and the wafer carrier moved by the actuator; and a laser detector for receiving the laser beam reflected from the one of the platen and the wafer carrier, for detecting a change in the time-of-flight for the laser beam, and for thereby detecting a change in the imparted motion indicative of a planar end-point on the opposing side of the semiconductor wafer.

6. The apparatus of claim 1 wherein the actuator comprises an electric motor.

7. The apparatus of claim 1 wherein the actuator comprises a hydraulic device.

8. The apparatus of claim 1 wherein the motion imparted by the actuator is translational.

9. The detection device of claim 1 wherein the actuator comprises a constant force actuator repetitively applying a constant force between the platen and the wafer carrier in opposite directions.

10. The detection device of claim 1 wherein the actuator causes the platen to repetitively move relative to the wafer carrier in a opposite directions.

11. The detection device of claim 10 wherein the sensor detects a characteristic in the imparted motion by detecting a characteristic of the motion imparted between the platen and the wafer carrier during a least two of the repetitive relative movements and comparing the characteristics to each other.

12. The detection device of claim 1 wherein the characteristic detected by the sensor is a change in the motion imparted between the platen and the wafer carrier.

13. A planar end-point detection device for a polishing apparatus, the polishing apparatus including a platen having a substantially planar surface, a polishing pad attached to the platen's substantially planar surface, a wafer carrier having a substantially planar surface to which one side of a semiconductor wafer is removably attachable so that an opposing side of the semiconductor wafer is disposed against the polishing pad, and an actuator to impart a motion to one of the platen and the wafer carrier so that the polishing pad moves relative to and in polishing contact with the semiconductor wafer, the imparted motion having a maximum translational distance that changes in magnitude when the coefficient of friction between the wafer and the polishing pad changes, the detection device comprising a sensor to detect a change in the maximum translational distance in the imparted motion resulting from a change in the coefficient of friction between the polishing pad and the opposing side of the semiconductor wafer indicative of a planar end-point on the opposing side of the semiconductor wafer.

14. The detection device of claim 13 wherein the actuator moves the platen to a maximum translational velocity whose magnitude changes when the coefficient of friction changes, wherein the sensor detects a change in the maximum translational velocity in order to detect a planar end-point on the opposing side of the semiconductor wafer.

15. The detection device of claim 13 wherein the sensor comprises an interferometer.

16. The detection device of claim 13 wherein the sensor comprises:

a laser for providing a laser beam incident on the one of the platen and the wafer carrier; and a laser detector for receiving the laser beam reflected from the one of the platen and the wafer carrier, for detecting a change in the time-of-flight for the laser beam, and for thereby detecting a change in the imparted motion indicative of a planar end-point on the opposing side of the semiconductor wafer.

17. The detection device of claim 13 wherein the motion imparted by the actuator is translational.

18. The detection device of claim 13 wherein the actuator comprises a constant force actuator repetitively applying a constant force between the platen and the wafer carrier in opposite directions.

19. The detection device of claim 13 wherein the actuator causes the platen to repetitively move relative to the wafer carrier in a opposite directions.

20. The detection device of claim 19 wherein the sensor detects a change in the imparted motion by detecting a characteristic of the motion imparted between the platen and the wafer carrier during a least two of the repetitive relative movements and comparing the characteristics to each other.

21. The detection device of claim 13 wherein the characteristic detected by the sensor is a change in the motion imparted between the platen and the wafer carrier.

22. A polishing method comprising:

positioning a semiconductor wafer against a polishing pad;

moving the polishing pad relative to the semiconductor wafer with a maximum translational distance that changes in magnitude when the coefficient of friction between the wafer and the polishing pad changes, the polishing pad being in polishing contact with the semiconductor wafer when the polishing pad moves relative to the wafer; and detecting a change in the maximum translational distance in the movement of the polishing pad relative to the semiconductor wafer resulting form a change in the coefficient of friction between the polishing pad and the semiconductor wafer indicative of a planar end-point on the semiconductor wafer.

23. The method of claim 22 wherein the polishing pad moves relative to the semiconductor wafer at a maximum translational velocity whose magnitude changes when the coefficient of friction changes, wherein detecting a change in the movement includes detecting a change in the maximum translational velocity.

24. The method of claim 22 wherein a change in the movement is detected using interferometry.

25. The method of claim 22 wherein a change in the movement is detected using time-of-flight laser reflection.

26. The method of claim 22 wherein the step of moving the polishing pad relative to the semiconductor wafer comprises repetitively moving the platen relative to the semiconductor wafer in opposite directions.

27. The method of claim 26 wherein the step of repetitively moving the polishing pad relative to the semiconductor wafer comprises applying a constant force between the platen and the semiconductor wafer in opposite directions.

28. The method of claim 26 wherein the step of detecting a characteristic in the movement of the polishing pad relative to the semiconductor wafer comprises detecting a characteristic of the motion imparted between the platen and the wafer carrier during a least two of the repetitive relative movements and comparing the characteristics to each other.

29. The method of claim 22 wherein the step of detecting a characteristic in the movement of the polishing pad relative to the semiconductor wafer comprises detecting a change in the motion imparted between the platen and the wafer.

30. A planar end-point detection device in a polishing apparatus, the polishing apparatus including a platen having a substantially planar surface, a polishing pad attached to the platen's substantially planar surface, a wafer carrier having a substantially planar surface to which one side of a semiconductor wafer is removably attachable so that an opposing side of the semiconductor wafer is disposed against the polishing pad, and an actuator to impart a motion to one of the platen and the wafer carrier so that the polishing pad moves relative to and in polishing contact with the semiconductor wafer, the actuator moving the one of the platen and the wafer carrier by a maximum translational distance having a magnitude which changes when the polishing pad polishes through to a planar end-point on the opposing side of the semiconductor wafer, the detection device comprising a sensor to detect a change in the magnitude of the maximum translational distance.

31. The detection device of claim 30 wherein the sensor comprises an interferometer.

32. The detection device of claim 30 wherein the sensor comprises:

a laser for providing a laser beam incident on the one of the platen and the wafer carrier; and a laser detector for receiving the laser beam reflected from the one of the platen and the wafer carrier, for detecting a change in the time-of-flight for the laser beam, and for thereby detecting a change in the magnitude of the maximum translational distance.

33. The detection device of claim 30 wherein the actuator comprises a constant force actuator repetitively applying a constant force between the platen and the wafer carrier in opposite directions.

34. A planar end-point detection device in a polishing apparatus, the polishing apparatus including a platen having a substantially planar surface, a polishing pad attached to the platen's substantially planar surface, a wafer carrier having a substantially planar surface to which one side of a semiconductor wafer is removably attachable so that an opposing side of the semiconductor wafer is disposed against the polishing pad, and an actuator to impart a motion to one of the platen and the wafer carrier so that the polishing pad moves relative to and in polishing contact with the semiconductor wafer, the actuator moving the one of the platen and the wafer carrier to a maximum translational velocity having a magnitude which changes when the polishing pad polishes through to a planar end-point on the opposing side of the semiconductor wafer, the detection device comprising a sensor to detect a change in the magnitude of the maximum translational velocity.

35. The detection device of claim 34 wherein the sensor comprises an interferometer.

36. The detection device of claim 34 wherein the sensor comprises:

a laser for providing a laser beam incident on the one of the platen and the wafer carrier; and a laser detector for receiving the laser beam reflected from the one of the platen and the wafer carrier, for detecting a change in the time-of-flight for the laser beam, and for thereby detecting a change in the magnitude of the maximum translational velocity.

37. The detection device of claim 34 wherein the actuator comprises a constant force actuator repetitively applying a constant force between the platen and the wafer carrier in opposite directions.

38. A planar end-point detection device in a polishing apparatus, the polishing apparatus including a platen having a substantially planar surface, a polishing pad attached to the platen's substantially planar surface, a wafer carrier having a substantially planar surface to which one side of a semiconductor wafer is removably attachable so that an opposing side of the semiconductor wafer is disposed against the polishing pad, and an actuator to move the platen and the wafer carrier back and forth relative to one another so that the polishing pad repeatedly moves relative to and in polishing contact with the semiconductor wafer, the actuator moving the platen and the wafer carrier relative to one another at a maximum translational velocity and to a maximum translational distance during each back and forth movement, the detection device comprising a sensor for detecting one of the maximum translational distance and the maximum translational velocity during each back and forth movement and for detecting a change in the detected one of the maximum translational distance and maximum translational velocity indicative of the polishing pad polishing through to a planar end-point on the opposing side of the semiconductor wafer.

39. The detection device of claim 38 wherein the sensor comprises an interferometer.

40. The detection device of claim 38 wherein the sensor comprises:

a laser for providing a laser beam incident on one of the platen and the wafer carrier; and a laser detector for receiving the laser beam reflected from the one of the platen and the wafer carrier, for detecting a change in the time-of-flight for the laser beam, and for thereby detecting a change in the detected one of the maximum translational distance and velocity indicative of a planar end-point on the opposing side of the semiconductor wafer.

41. The detection device of claim 38 wherein the actuator comprises a constant force actuator repetitively applying a constant force between the platen and the wafer carrier in opposite directions.

* * * * *